US005595122A

United States Patent [19]

Levi et al.

[11] Patent Number: 5,595,122

[45] Date of Patent: Jan. 21, 1997

[54] FUNICULAR SYSTEM OF RAIL AND RUNNING CABLE TYPE

[75] Inventors: Ferruccio Levi, Cologno Monzese; Giuseppe Conte, Bolzano, both of Italy

[73] Assignee: Leitner S.p.A., Bolzano, Italy

[21] Appl. No.: 491,453

[22] Filed: Jun. 16, 1995

[30] Foreign Application Priority Data

Jun. 16, 1994 [IT] Italy ..... MI94A1256

[51] Int. Cl.[6] ..... B61B 12/00

[52] U.S. Cl. ..... 104/173.1; 104/209; 104/215; 104/220

[58] Field of Search ..... 104/130.09, 168, 104/165, 184, 187, 190, 173.1, 204, 206, 209, 211, 215, 220

[56] References Cited

U.S. PATENT DOCUMENTS

| | | | |
|---|---|---|---|
| 3,812,788 | 5/1974 | Laurent | 104/184 X |
| 3,871,303 | 3/1975 | Woodling | 104/173.1 |
| 4,403,552 | 9/1983 | Kunczynski | 104/206 |
| 4,785,737 | 11/1988 | Pabst | 104/173.1 |
| 5,111,751 | 5/1992 | Zlotek | 104/211 X |

FOREIGN PATENT DOCUMENTS

| | | |
|---|---|---|
| 0461098A1 | 12/1991 | European Pat. Off. . |
| 0573344A1 | 12/1993 | European Pat. Off. . |
| 1131718 | 6/1962 | Germany . |
| 1384101 | 2/1975 | United Kingdom . |

*Primary Examiner*—Mark T. Le
*Attorney, Agent, or Firm*—Oblon, Spivak, McClelland, Maier & Neustadt, P.C.

[57] ABSTRACT

In order to operate both arms of a clamp of a funicular system of a rail and running cable vehicle with the same force and at the same time, a guide carrier element, which includes two longitudinal surfaces over which the free ends of the movable jaws move, is formed in one piece and can move vertically transverse to the free ends so as to be instantaneously and automatically self-centering about the jaws and hence about the clamp.

17 Claims, 7 Drawing Sheets

FUNICULAR SYSTEM OF RAIL AND RUNNING CABLE TYPE

BACKGROUND OF THE INVENTION

1. Field of the Invention

This invention relates to a funicular system of rail and running cable type, in particular for urban transport, of the type in which the vehicles are provided with movable jaw clamps for their automatic coupling to and release from said running cable. A funicular system known from the document EP-A-0 461 098.

In said system, in order to be able to brake and/or accelerate the vehicle in a region where its movement is to be interrupted, usually at an intermediate or non-intermediate station along its route, synchronized rollers are used. The clamp, which comprises two movable jaws, necessarily has to be released from the running cable when the synchronized rollers decelerate or accelerate the vehicle. However, because of inevitable shifting of the vehicle relative to the track due for example to the load or dynamic forces etc., the position of the clamp relative to the means which operate it in the sense of opening and closing it, and which are rigid with the track, is neither constant nor determinable with the required precision.

The result is that passage from traction by cable to traction by rollers and vice versa can often involve irregularities (such as implusive stresses and/or excessive wear of certain mechanical members of the system) and a lessening in running comfort for the passengers precisely at a delicate stage when some of them are preparing to get off or have just gotten on.

SUMMARY OF THE INVENTION

The object of the present invention is to obviate the aforesaid drawbacks by providing a funicular system, in particular for urban transport, of the type in which the vehicles are provided with at least one movable jaw clamp for their coupling to and release from the running cable, which offers particular running uniformity especially at those points of the route where the vehicles are subjected to a traction change, such as in stations during stopping and starting.

In the aforesaid system if, because of wear, load variations or other phenomena, initially only one movable arm of the clamp comes into contact with the guide carrier element, said guide carrier element is automatically shifted by said movable arm in a transverse vertical direction until the remaining movable arm of the clamp is able to engage it. Consequently the movable clamp arms are operated only when both are in contact with the guide carrier element and with two equal and opposite forces. The perfectly symmetrical action of the movable arms therefore produces the condition which is essential for correct operation of a clamp comprising two movable jaws, and hence for optimum running comfort during the subsequent vehicle deceleration and acceleration by synchronized rollers.

Hence by supporting the guide carrier element in a manner movable transversely to the direction of the running cable and hence also to the vehicle direction, small variations in relative position between the clamp and its operating means are automatically compensated.

Moreover as the guides are connected rigidly together there is maximum assurance that each point of the longitudinal surfaces along which the free ends of the movable jaws slide is at the optimum distance relative to the considered point on the route for operation of the clamp.

BRIEF DESCRIPTION OF THE DRAWINGS

The technical characteristics and further advantages of the present invention will be more apparent from the description given hereinafter by way of non-limiting illustration with reference to the accompanying drawings, in which.

DESCRIPTION OF THE PREFERRED EMBODIMENT

Figure 1:
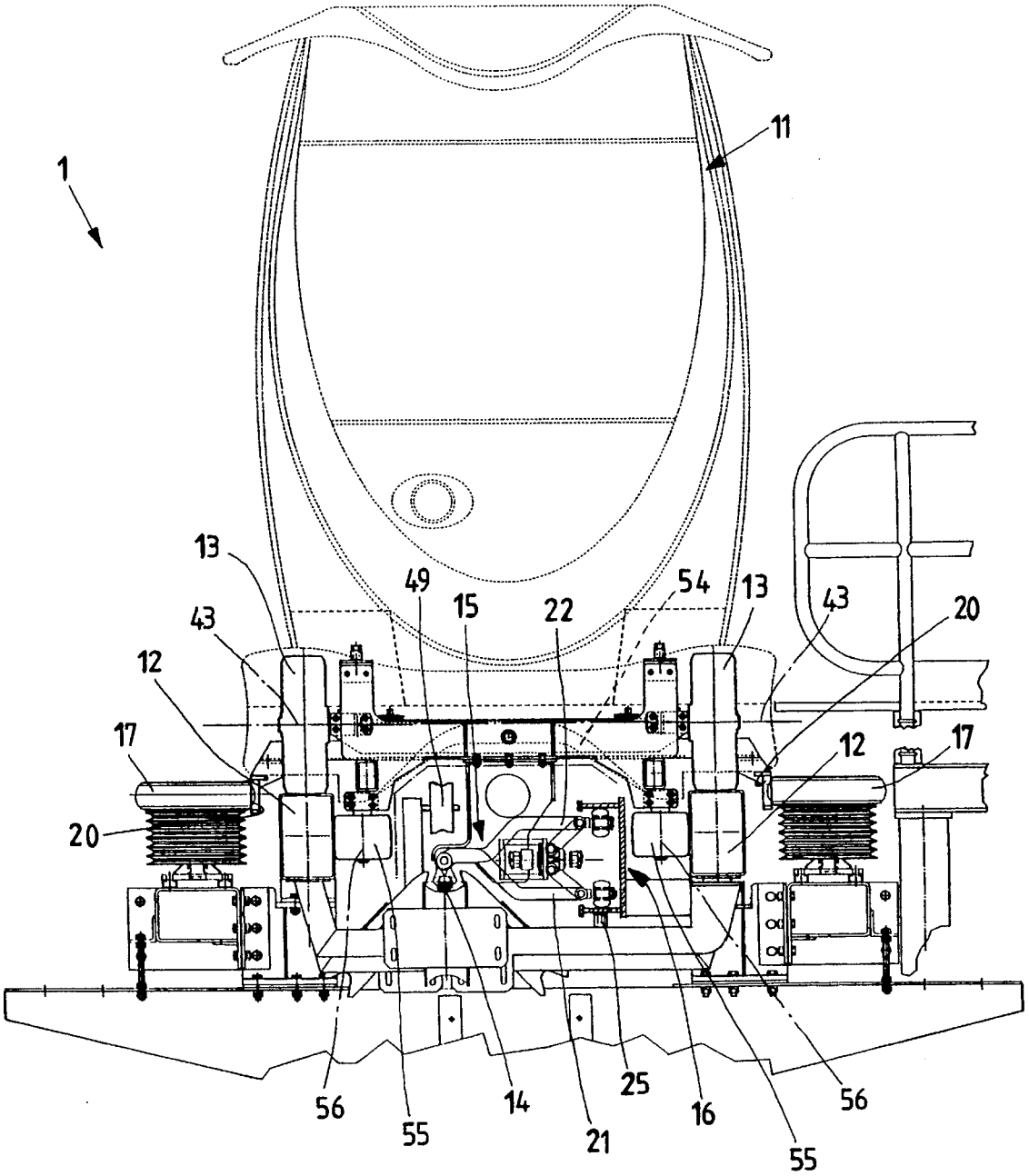
FIG. 1 is a transverse view of the transport system and a relative funicular vehicle.
Figure 2:
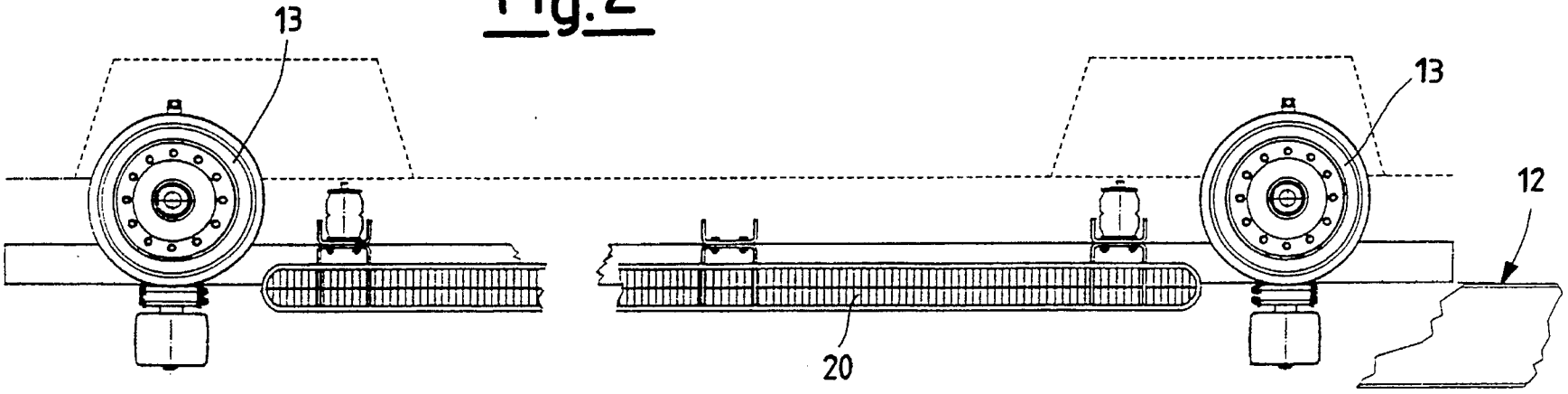
FIG. 2 is a side view of an enlarged detail of the funicular vehicle of FIG. 1.

With reference to the aforesaid figures and in particular to FIGS. 1 and 2, the funicular system of rail and running cable type according to the invention, indicated overall by 1, is of the type in which the vehicles are provided with movable jaw clamps for their automatic coupling to and release from said running cable. The system is particularly intended for urban transport but this does not exclude further applications. Each funicular vehicle 11 moves on rails 12 via wheels 13 and is operated by a running cable 14. The vehicle 11 is connected to the running cable 14 by a double-acting clamp 15. The clamp 15 is arranged parallel to the axis of rotation 43 of the wheels 13 of the vehicle 11. Specifically, the clamp 15 consists of movable arms 21, 22 positioned parallel to the axis of rotation 43 of the wheels 13 of the vehicle 11, and of movable jaws 41, 42 arranged in a direction perpendicular to the axis of rotation 43 of said wheels 13. The movable jaws 41, 42 face downwards.

The clamp 15 is released from the running cable 14 and coupled to it by the same operating device 16. Before the clamp 15 is released from the running cable 14, which moves continuously at constant speed, a plurality of acceleration-deceleration rollers 17 are brought automatically into contact with a respective runway 20 to be able to accelerate/decelerate the vehicle 11. The rollers 17 are synchronized and are positioned according to the present invention to the side of the respective rail 12 in two groups, the first of which is indicated by 18 and the second by 19 in FIG. 3*a*. In the illustrated embodiment at least two, but preferably three, synchronized rollers 17 of each group 18, 19 can simultaneously operate on the runway 20. Consequently the synchronized rollers 17 are able to accelerate the vehicle 11 to the same speed as the running cable 14. Coupling between the clamp 15 and running cable 14 is effected automatically by the operating device 16 without any relative movement occurring between the running cable 14 and the jaws 41, 42, because of the simultaneousness of the action of the movable arms 21 at a determined point due to the ability of the operating device 16 to move.

Advantageously a single motor 50 operates the synchronized rollers of both groups 18, 19.

Advantageously the runway 20 of the vehicle 11 is formed by a grid to always ensure optimum contact with the synchronized rollers 17 without slippage, independently of whether said grid is or is not covered with ice. In this respect, if ice forms, said rollers 17 tend to eliminate it by pushing it beyond the grid. Consequently as the rollers 17 during their thrust action on the grid of the runway 20 tend to free it of ice, slippage-free, ie uniform, acceleration or deceleration is ensured, particularly when the vehicle is travelling at full load.

In addition, as can be seen from FIG. 1, the funicular system according to the invention can also be advantageously provided with cable guide and retention rollers 49 arranged along the line between the running cable 14 and the vehicle 11. This arrangement is possible because of the particular structure of the clamp 15 as described hereinafter. The clamp 15 is of the double-acting type for coupling a funicular vehicle 11 to the running cable 14 and comprises, symmetrically arranged about an axis 10, a pair of movable operating arms 21, 22 for the jaws 41, 42, and to which arms 8 for operating elastic means 30 are hinged. The operating arms 21, 22 for the jaws 41, 42 are hinged to the funicular vehicle 11 at their second ends and carry at each of said second ends a jaw cooperating with and in opposition to the remaining jaw to grip the running cable 14. The jaw operating arms 21, 22 are connected together at their second ends by a single hinge 5. The arms 21, 22 bound a space 9 housing both the elastic means 30 and the operating arms 8 for the elastic means. The jaw operating arms 21, 22 are provided at their first ends with bearings 7 for reducing friction when said first ends interact with a pair of opposing operating guides 29.

The jaws 41, 42 extend along an axis 4 which is substantially perpendicular to the axis of symmetry 10. The operating arms 8 for the elastic means 30 have their first ends hinged to the first ends of the jaw operating arms 21, 22 in such a manner as to form an acute contained angle ($\alpha$) with its concavity facing the interior of the space 9 defined by said jaw operating arms 21, 22. The operating arms 8 for the elastic means 30 have their second ends hinged to an element 6 able to slide axially 10 on at least one guide 3 and arranged to act on elastic means 30 operating parallel to the axis 10 of said guide 3.

The clamp 15 comprises a box 2 by which it is fixed to the funicular vehicle 11. The first hinge 5 and the guide 3 are fixed to said box structure 2.

The elastic means consist of two precompressed helical springs 30 positioned between a fixed thrust plate 51 rigid with the box structure 2 and a movable thrust plate 52 positioned on the sliding element 6. The slide guide 3 for the element 6 is positioned between said springs 30 and parallel to them. Two operating arms 8 for the elastic means are provided for each jaw operating arm 21, 22.

The bearings 7 applied to the first ends of the jaw operating arms 21, 22 are preferably of rolling-contact type. The jaw operating arms 21, 22 are preferably of rectangular cross-section.

According to the present invention, the clamp 15 is mounted on the vehicle in such a manner that the jaws 41, 42 and the running cable 14 interact by moving relative to each other in a vertical direction. This allows reliable coupling and release of the jaws 41, 42 to and from the running cable 14 as said elements interact by moving in a vertical plane.

Again according to the invention, the elastic means 30 lie between the clamp operating arms 21, 22, which extend horizontally. In this manner the overall size of the clamp in a vertical direction is tendentially reduced, to the advantage of the position of the vehicle loading floor and hence of the overlying loading space. In this respect, for equal vehicle capacity, the following can be obtained:

lesser vertical vehicle height;

improved arrangement of the vehicle mechanical members;

improved arrangement of those line members which have to operate in the vicinity of the clamp.

The illustrated clamp is of the type commonly known as "without dead center", ie a clamp which closes spontaneously when the action of the operating guide 29 on the bearings 7 ceases. However by simply varying the measurements of its constituent linkages a similar clamp of the "with dead center" type can be obtained, ie a clamp which for its closure must be acted upon by an action opposite to that which has caused it to open. Essentially the existence of one or the other constructional type depends on the distance of the axis of the hinge 5 from the point of intersection of the axes 24 of the operating arms 8 with the axis 10.

For safety reasons it is preferable to provide each funicular vehicle 11 with at least two clamps 15, each of which is secured to one of the axles 54 situated at the two ends of the vehicle 11. Each clamp 15 is hence positioned between the pairs of wheels 13 of horizontal axis 43 and the pair of wheels 55 of vertical axis 56, which run along the rails 12.

Figure 3A:
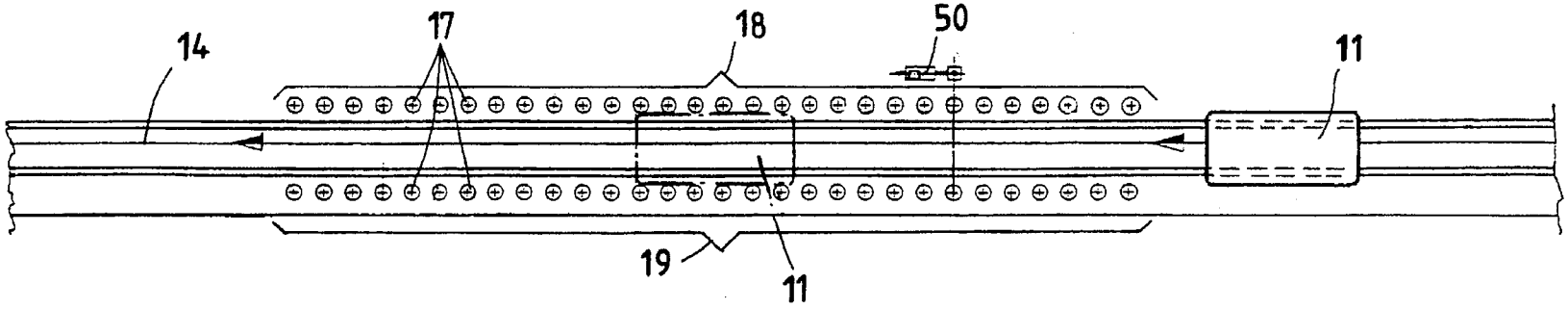
FIG. 3*a* is a view from above of the transport system of FIG. 1 on a reduced scale.

FIG. 3*a* shows a transport system in which the funicular vehicle 11 is fixed to the running cable 14 by the clamp 15, and hence coupled. The vehicle 11 shown by dashed lines is, however, under the action of the synchronized rollers 17, so that the clamp 15 is completely released from the running cable 14 by interaction with the operating device 16.

Figure 3B:
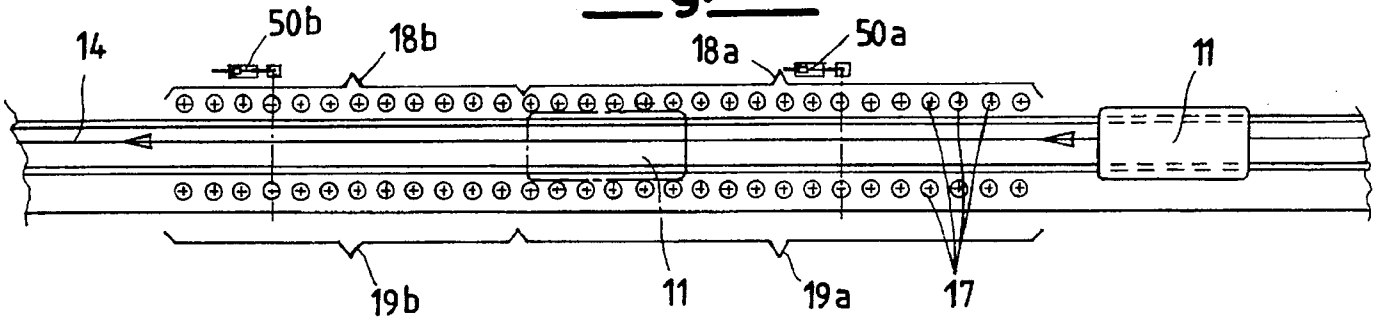
FIG. 3*b* is a view from above of a further embodiment of the transport system on a reduced scale.

FIG. 3*b* shows a further embodiment of the system which is of high capacity enabling two or more vehicles 11 to be present in the same station. In this case two groups of rollers 18 and 19 are provided divided into a number of consecutive sections 18*a*/19*a* and 18*b*/19*b*, each section operated being by a respective motor 50*a*, 50*b*, so that, for example, one vehicle can be accelerated while another is to be decelerated.

Figure 4:
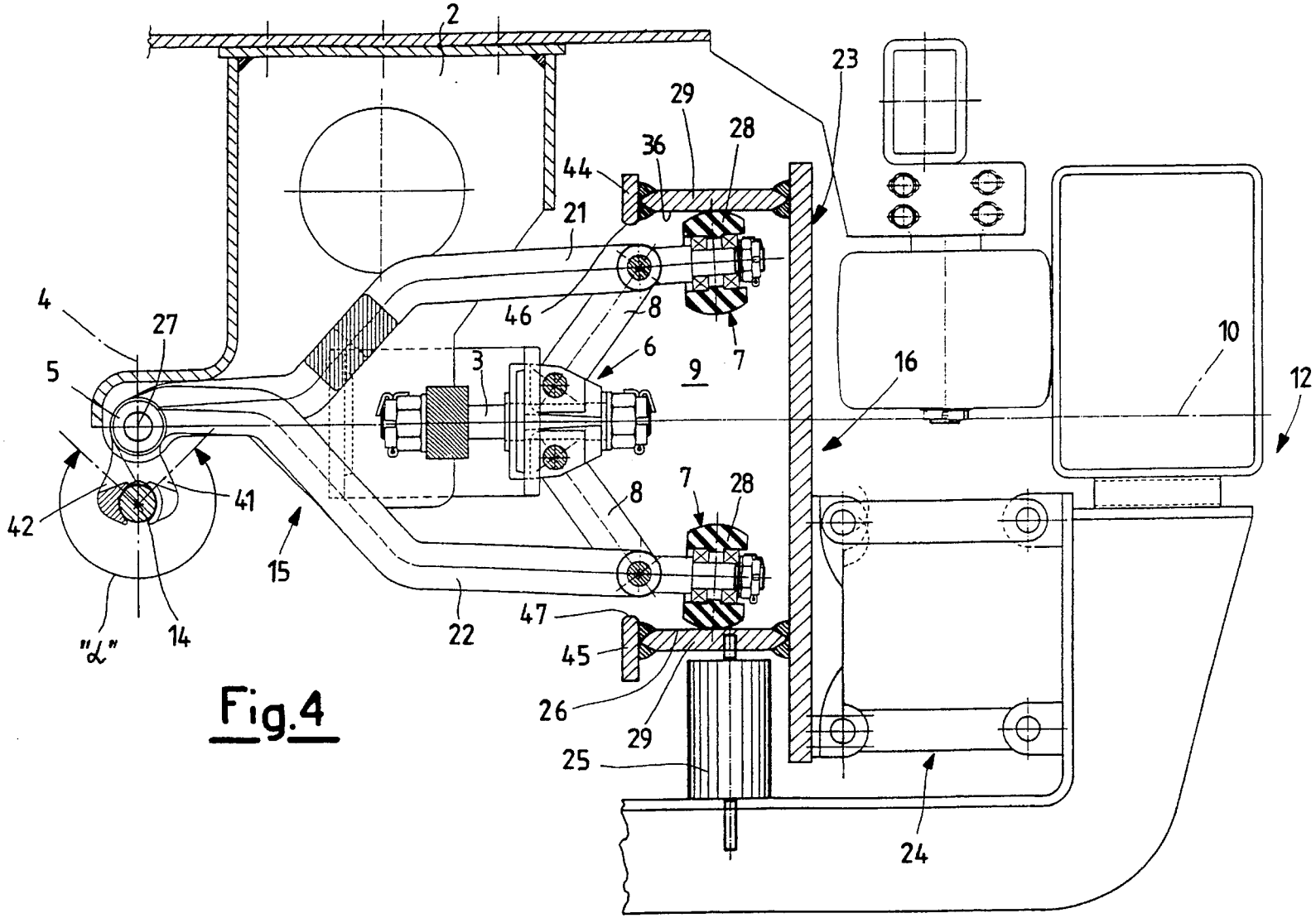
FIG. 4 is a partly sectional enlarged transverse view with the clamp of the vehicle of FIG. 1 coupled to the running cable.

In addition to the movable jaw clamp 15 coupled to the running cable 14, FIG. 4 also shows a guide carrier element 23. Said element 23 is arranged parallel to the running cable 14, and has a one-piece structure formed in the illustrated embodiment by welding a number of pieces together. The element 23 is supported by the track 12 of the transport system (or on the ground) so as to be able to move in a vertical direction transverse to the direction of advancement of the running cable 14, while remaining parallel to itself. This is due to the fact that said guide carrier element 23 is connected to the track by an articulated parallelogram device 24 which is preferably associated with a damper 25 able to dampen the dynamic forces during interaction between the bearings 7 and the operating guides.

The guide carrier element 23 comprises two longitudinal surfaces 26 and 36 on which the free ends of the relative arms 21 and 22 provided with bearings 7 slide during operation of the clamp 15.

During the opening of the clamp 15 there is a simultaneous mutual approach of the arms 21, 22 because of the rotation of said two arms 21 and 22 about the axis of rotation 27. The reverse occurs during closure.

The presence of the articulated parallelogram device 24 results in perfectly symmetrical operation of the movable arms 21, 22, thus achieving the essential condition for correct operation of a clamp with two movable jaws and hence optimum running comfort during the subsequent deceleration or acceleration of the relative vehicle by means of the synchronized rollers 17.

Hence a main advantage of the system according to the present invention is the mobility of the guide carrier element 23 formed in one piece, this mobility arising by virtue of the parallelogram 24. In this respect, following contact with only one of the two arms 21 and 22, the guide carrier element 23 becomes immediately and automatically positioned to provide the arms 21 and 22 with two respective reaction surfaces 36 and 26 in a perfectly synchronous manner. This ensures immediate and symmetrical opening of the clamp 15 with two equal and opposite coaxial forces which therefore have no resultant force and hence do not load the vehicle members with undesirable forces. According to the present invention the parallelogram 24 can be replaced by any elastic means (not shown) providing a support for the guide carrier element 23 such that it can move transversely to the direction of advancement of the running cable 14 and parallel to itself.

In the embodiment shown in FIG. 4 the single guide carrier element 23 is in the form of a C-shaped beam, in which the two flanges 29 comprise a free end 44, 45, respectively, which is of a T or L shape with an edge projecting into the internal space of the C-shaped beam. This ensures that if one of the arms 21, 22 breaks or if one of the rollers 28 is lost, the respective edges 46, 47 projecting into the internal space of the beam automatically come into contact with the remaining part of the corresponding arm 21, 22 to hence still effect the necessary and safe opening and/or closure of the clamp 15.

Figure 5:
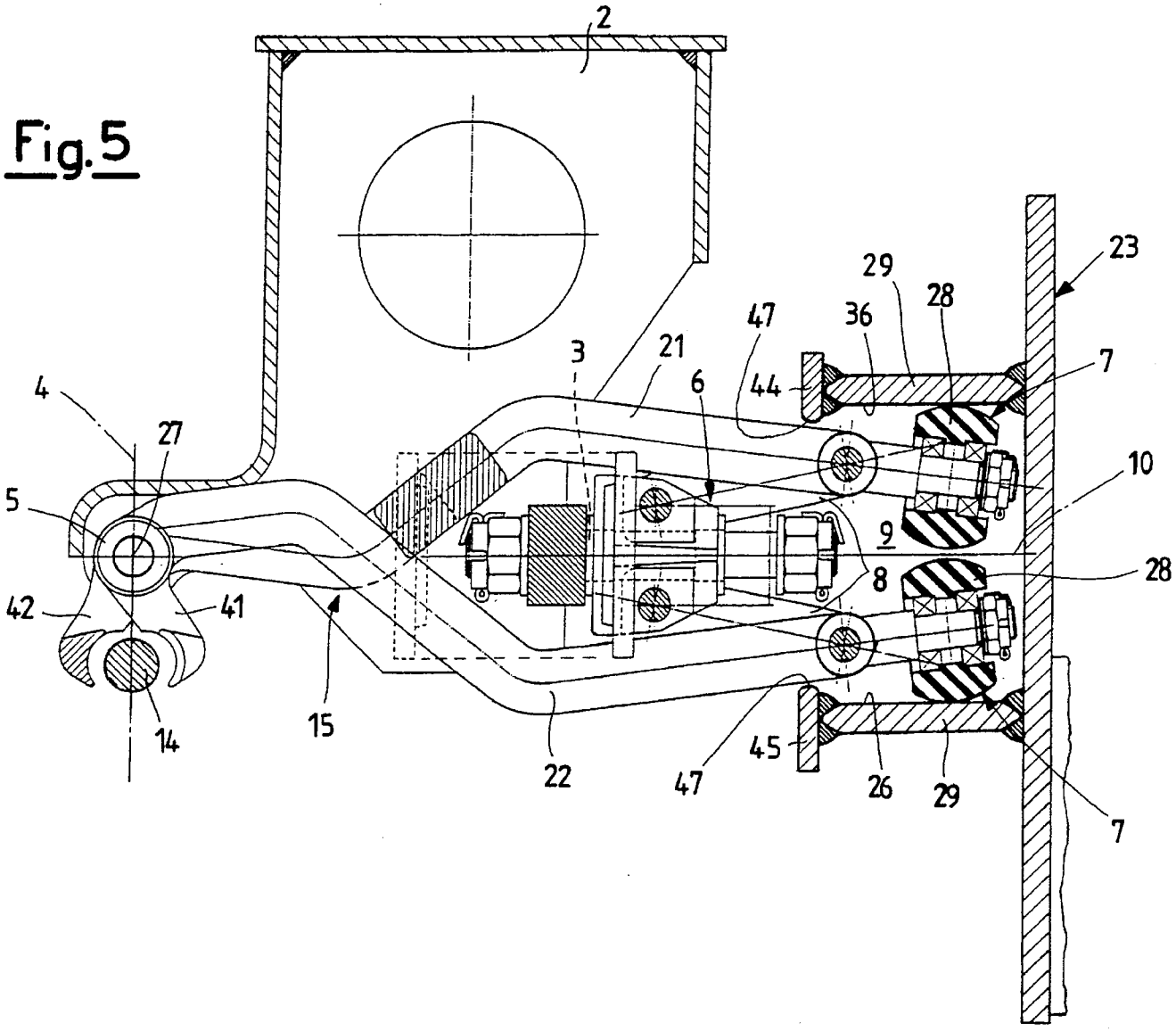
FIG. 5 is a partly sectional enlarged transverse view with the clamp of the vehicle of FIG. 1 released from the running cable.

FIG. 5 shows the clamp 15 in the open position and hence released from the running cable 14 following the mutual approach of the movable arms 21, 22 by virtue of their rotation about the axis 27. This movement is determined by the particular form of the guide carrier element 23, ie by the progressive reduction in the distance between the two flanges 29 or rather between the two longitudinal surfaces 26 and 36 in the direction of advancement of the funicular vehicle 11.

Figures 6, 8:
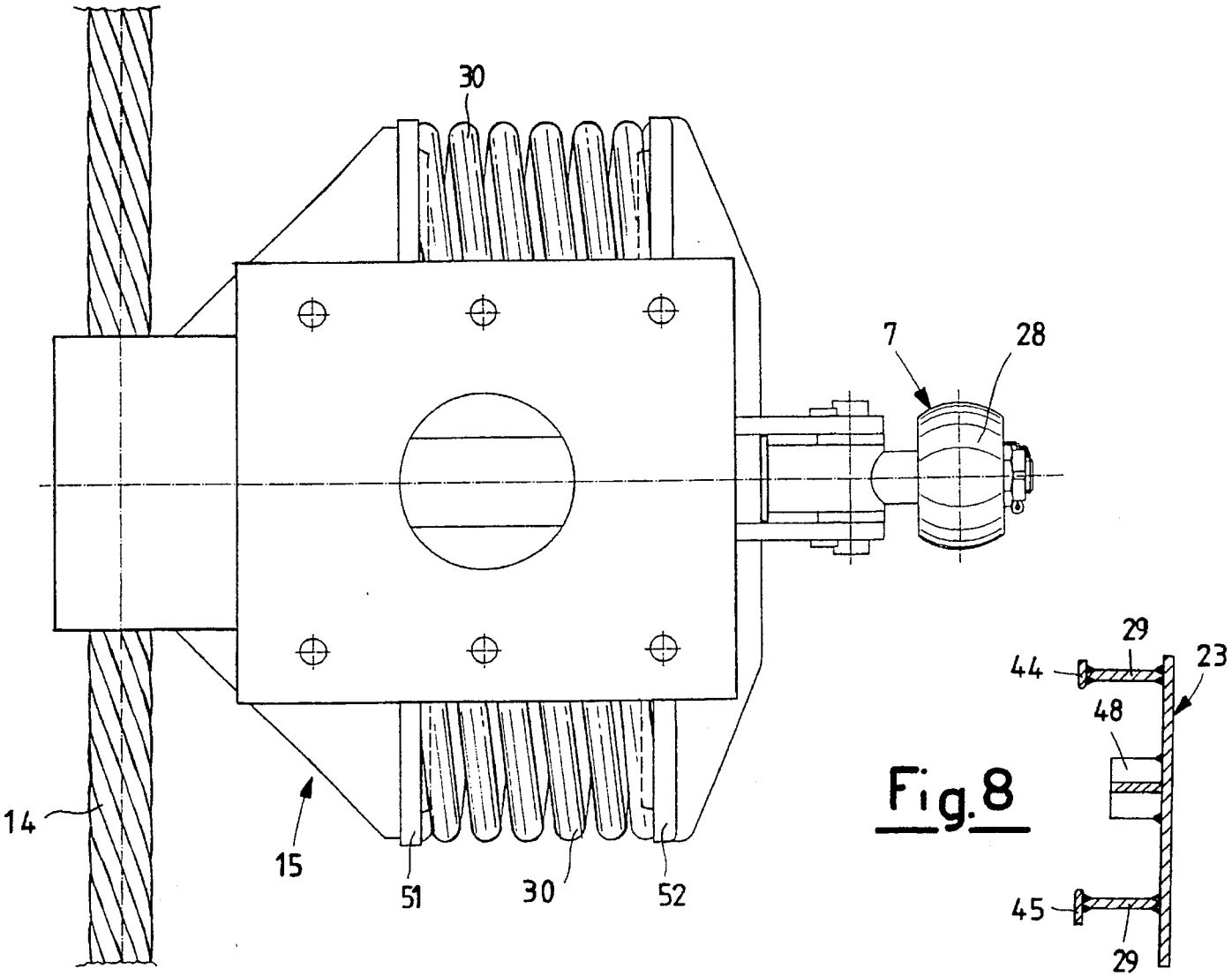
FIG. 6 is an enlarged view from above of the clamp of FIG. 4.
FIG. 8 is a schematic cross-section through the guide carrier element.

The rotational movement of the two arms 21 and 22 about the appropriate axis 27 takes place against the action of an elastic means 30, for example a spring or a plurality of springs, as shown in FIG. 6. In this case two helical springs 30 are provided, positioned according to the present invention between the two movable arms 21 and 22 of the clamp 15, advantageously in a direction parallel to these.

Figure 7B:
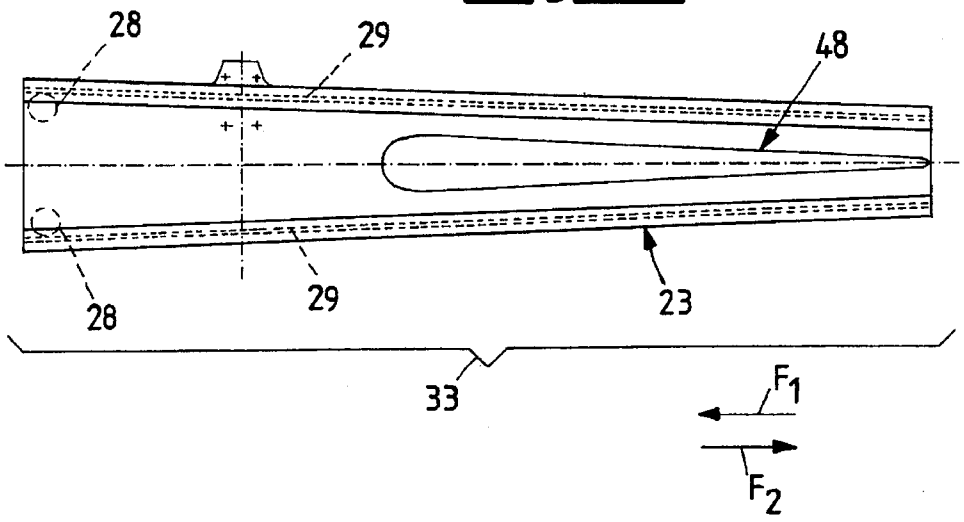
FIG. 7*b* is a reduced-scale side view of a further embodiment of the guide carrier element.
Figure 7A:
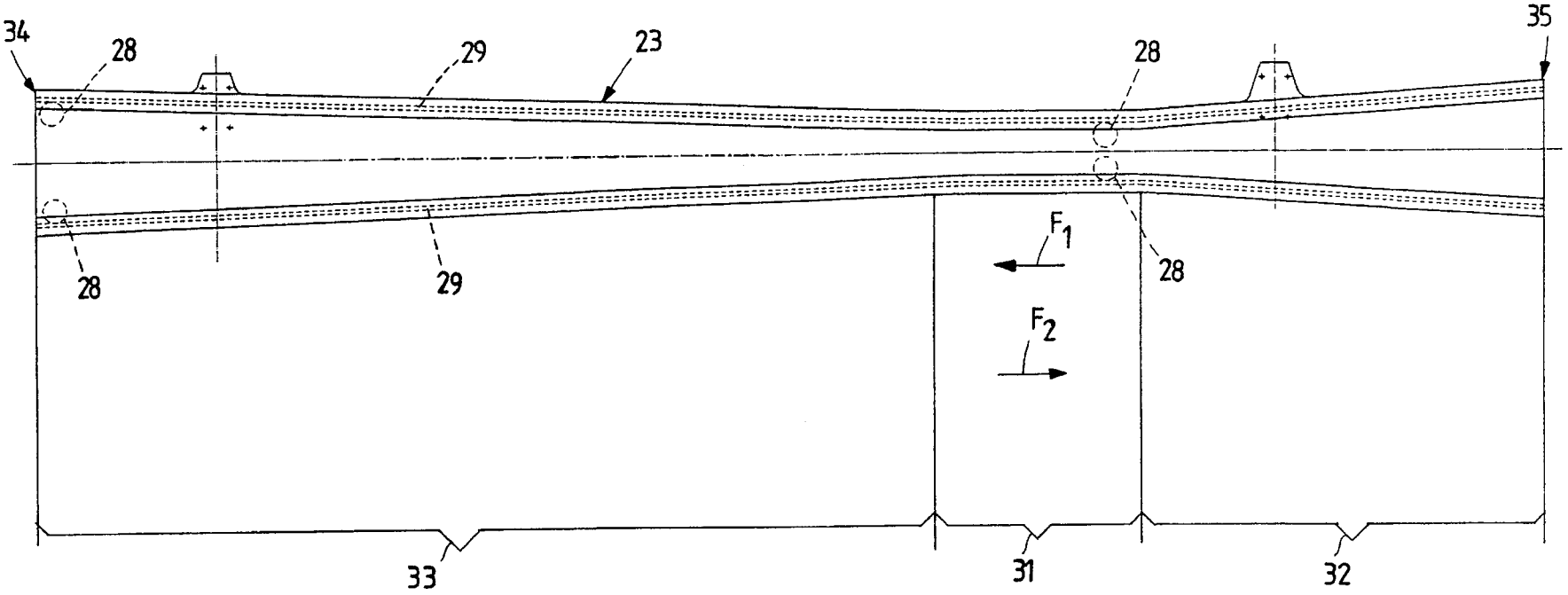
FIG. 7*a* is a reduced-scale side view of the guide carrier element of the system of FIG. 1.

FIG. 7*a* is a side view of a single guide carrier element 23. The clamp 15 (not shown) is coupled to the running cable 14 (not shown) in the direction F1 and is released from the running cable 14 in the direction F2. For both directions F1 and F2 of advancement of the running cable 14 and hence of the vehicles, the guides 29 firstly converge, are then parallel and then diverge, and are hence able to act on the arms 21, 22 by interference with the rollers 28. The guide carrier element 23 therefore comprises a central region 31 in which the distance between the two flanges 29 and hence between the two inner longitudinal surfaces 26 and 36 is constant. The guide carrier element 23 then comprises, for example in the direction F1, an entry region 32 and an exit region 33 which are shaped such that the two respective flanges 29 extend diverging in the longitudinal direction towards the respective end 34 and 35 of the guide carrier element 23.

The two transverse direction end positions of the rollers 28 of the clamp 15 are shown by dashed-line circles. When in the central region 31 the clamp 15 is open and is hence released from the running cable 14, as shown in FIG. 5. When in the entry region 32 or exit region 33, in particular close to the ends 34 and 35, the clamp 15 is in its closed position coupled to the running cable 14 as shown in FIG. 4, or closed but not coupled to the running cable 14.

When the vehicle 11 enters the entry region 32 with the same constant speed as the running cable 14, one or more synchronized rollers 17 of each group 18, 19 come into contact with the respective runway 20. The rollers 28 of the two movable arms 21 and 22 slide along the longitudinal surfaces 26 and 36 to operate the clamp 15.

Advantageously and according to the present invention, the vehicle 11 is braked simultaneously by action on both sides. Three synchronized rollers 17 act simultaneously on each side. Their number ensures reliable and precise regulation of the speed of the vehicle 11 in any situation, in particular if the vehicle 11 is fully loaded.

The vehicle 11 is halted in the halt region for example to allow passengers to get on and/or off, and possibly to allow loading and unloading of goods. The vehicle 11 is then accelerated by the synchronized rollers 17 until it reaches the same speed as the running cable 14 to enable the clamp 15 to be coupled to the running cable 14 by the action of the operating device 16. If preferred, the synchronized rollers 17 can be operated by two or more motors (see FIG. 3*b*) so as to be able to simultaneously control more than one vehicle in the same station. In particular, by increasing the number of drives for the rollers 17 (preferably three or more), one vehicle can be accelerated and another decelerated simultaneously in the same station without the two vehicles mutually interfering. This characteristic enables both the capacity and the flexibility of use of the system to be improved.

According to the present invention the entry region 32 can have an angle of convergence towards the cable which is different from the corresponding angle of the exit region, provided that both the flanges 29 of the two regions extend symmetrically in the longitudinal direction about said cable.

If "dead centre" clamps are used, ie clamps which remain open by themselves, the guide carrier element 23 can consist only of the exit region 33 (as shown in FIG. 7*b*). In this case the guide carrier element 23 must necessarily be provided in the exit region 33 with a wedge 48 to cause "dead centre" clamps to close in the direction F1. The wedge 48 is rigidly fixed to the guide carrier element 23 within the interior space thereof between the two flanges 29, as shown in FIG. 8.

The guide carrier element 23 can be constructed for example of steel. The system according to the present invention can comprise open, closed or other cabins.

The length of the guide carrier element 23, its type of convergence/divergence and its position along the route can vary according to requirements.

Obviously, numerous modifications and variations of the present invention are possible in light of the above teachings. It is therefore to be understood that within the scope of the appended claims, the invention may be practiced otherwise than as specifically described herein.

We claim:

1. A funicular system which utilizes a rail and running cable in which the movement of a vehicle is controlled, during stopping and starting, thereof by motorized rollers positioned on at least one side of the system, which comprises:

a cable;

at least one clamp comprising two operating arms having movable jaws, said jaws being selectively coupleable to and releasable from said cable;

a pair of guides respectively acting on the free ends of the operating arms of said movable jaws, said arms being movable to cause said movable jaws to be movable apart to open said movable jaws and to be moveable to close said movable jaws wherein said guides (29) are rigidly connected together and form a single guide carrier element supported in such a manner as to be movable vertically parallel to itself wherein said guide carrier element is vertically movable by said free ends of the operating arms only in operation of said operating arms such that said guide carrier is instantaneously and automatically self-centered about said operating arms.

2. A funicular system (1) as claimed in claim 1, wherein:

the operating arms of the movable jaws are connected together at second ends by a single hinge (5);

said arms bound a space which houses an elastic mechanism and additional operating arms connected to said elastic means mechanism;

said operating arms of the jaws are provided at first ends thereof with bearings reducing friction when said free ends interact with said pair of guides;

the jaws extend along an axis substantially perpendicular to an axis of symmetry of said operating arms of the jaws;

the additional operating arms of the elastic mechanism have first ends thereof hinged to the free ends of the operating arms of the jaws so as to form an acute angle with a concavity thereof facing the interior of the space defined by said operating arms of the jaws; and the operating arms of the elastic mechanism have the second ends thereof hinged to an element axially slidable on at least one guide acting on said elastic mechanism and wherein said elastic mechanism is operable parallel to the axis of said guide.

3. A funicular system as claimed in claim 1, which comprises a rail and a lever device wherein said single guide carrier element is connected to said rail via said lever device and said lever device is in the form of a parallelogram.

4. A funicular system as claimed in claim 3, which comprises a damper engagable with said guide carrier element.

5. A funicular system (1) as claimed in claim 4, wherein said single guide carrier element comprises a C-shaped beam which has two longitudinal surfaces located opposite each other on inside portions of two flanges of the beam.

6. A funicular system (1) as claimed in claim 5, wherein said two flanges of said C-shaped beam divergingly extend in the longitudinal direction towards opposite ends of said beam.

7. A funicular system as claimed in claim 6, wherein in a central region of said guide carrier element the distance between said two inside surfaces thereof is constant.

8. A funicular system as claimed in claim 5, wherein said two flanges each comprise a free end which is one of a T shape and an L-shape with an edge thereof projecting into an internal space of said C-shaped beam.

9. A funicular system as claimed in claim 8, wherein said motorized rollers are divided into two groups of cylindrical rollers which respectively act on two opposite sides of the vehicle.

10. A funicular system as claimed in claim 9, wherein each of said groups of cylindrical rollers is divided into at least two consecutive sections individually operated by a respective motor.

11. A funicular system as claimed in claim 10, wherein said single guide carrier element includes a wedge.

12. A funicular system as claimed in claim 11, wherein said single guide carrier element comprises an exit region.

13. A funicular system as claimed in claim 1, which comprises a box structure connecting the system to the funicular vehicle wherein both the hinge and the guide are fixed to said box structure (2).

14. A funicular system as claimed in claim 2, wherein the elastic mechanism comprises two precompressed helical springs positioned between a fixed thrust plate rigidly connected with the box structure and a movable thrust plate positioned on the sliding element, the slide guide for the sliding element being positioned between said springs (30) and parallel thereto.

15. A funicular system as claimed in claim 2, wherein the bearings provided at the first ends of the operating arms comprise rolling contact bearings.

16. A funicular system as claimed in claim 2, wherein the operating arms of the jaws each has a rectangular cross-section.

17. A funicular system as claimed in claim 1, wherein the funicular vehicle comprises a rail operated vehicle.

* * * * *